US008951703B2

(12) United States Patent
Reeves et al.

(10) Patent No.: US 8,951,703 B2
(45) Date of Patent: Feb. 10, 2015

(54) WEAR RESISTANT URETHANE HEXAACRYLATE MATERIALS FOR PHOTOCONDUCTOR OVERCOATS

(71) Applicant: Lexmark International, Inc., Lexington, KY (US)

(72) Inventors: Scott Daniel Reeves, Louisville, CO (US); David Glen Black, Broomfield, CO (US)

(73) Assignee: Lexmark International, Inc., Lexington, KY (US)

( * ) Notice: Subject to any disclaimer, the term of this patent is extended or adjusted under 35 U.S.C. 154(b) by 94 days.

(21) Appl. No.: 13/731,555

(22) Filed: Dec. 31, 2012

(65) Prior Publication Data

US 2014/0186757 A1 Jul. 3, 2014

(51) Int. Cl.
*G03G 5/147* (2006.01)

(52) U.S. Cl.
CPC ..... *G03G 5/14769* (2013.01); *G03G 5/14786* (2013.01); *G03G 5/14791* (2013.01)
USPC ..... 430/66

(58) Field of Classification Search
USPC ..... 430/66
See application file for complete search history.

(56) References Cited

U.S. PATENT DOCUMENTS

| | | | | |
|---|---|---|---|---|
| 5,545,499 | A | 8/1996 | Balthis | |
| 5,925,486 | A | 7/1999 | Levin | |
| 6,001,523 | A | 12/1999 | Kemmesat | |
| 6,004,708 | A | 12/1999 | Bellino | |
| 6,033,816 | A | 3/2000 | Luo | |
| 6,071,660 | A | 6/2000 | Black | |
| 6,232,025 | B1 | 5/2001 | Srinivasan | |
| 6,265,124 | B1 | 7/2001 | Luo | |
| 6,376,143 | B1 | 4/2002 | Neely | |
| 7,358,017 | B2 | 4/2008 | Reeves | |
| 7,387,861 | B2 | 6/2008 | Black | |
| 7,390,602 | B2 | 6/2008 | Reeves | |
| 7,642,027 | B2 | 1/2010 | Hartman | |
| 7,955,769 | B2 | 6/2011 | Black | |
| 8,257,889 | B2 | 9/2012 | Cote | |
| 2007/0134570 | A1 | 6/2007 | Hartman | |
| 2011/0207039 | A1* | 8/2011 | Yamada et al. | 430/56 |
| 2011/0215303 | A1* | 9/2011 | Yamada et al. | 257/40 |
| 2012/0100472 | A1* | 4/2012 | Sonobe et al. | 430/56 |

* cited by examiner

*Primary Examiner* — Hoa V Le

(57) ABSTRACT

An overcoat layer for an organic photoconductor drum of an electrophotographic image forming device is provided. The overcoat layer is prepared from a curable composition including a urethane resin having at least six radical polymerizable functional groups. The at least six radical polymerizable functional groups may include acrylate group, methacrylate group, styrenic group, allylic group, vinylic group, glycidyl ether group, epoxy group, or combinations thereof. This overcoat layer has an improved wear resistance, thus protecting the organic photoconductor drum from damage and extending its useful life.

14 Claims, 2 Drawing Sheets

WEAR RESISTANT URETHANE HEXAACRYLATE MATERIALS FOR PHOTOCONDUCTOR OVERCOATS

CROSS REFERENCES TO RELATED APPLICATIONS

None.

BACKGROUND

1. Field of the Disclosure

The present disclosure relates generally to electrophotographic image forming devices and more particularly to a wear abrasion resistant overcoat layer for an organic photoconductor drum.

2. Description of the Related Art

Organic photoconductor drums have generally replaced inorganic photoconductor drums in electrophotographic image forming device including copiers, facsimiles and laser printers due to their superior performance and numerous advantages compared to inorganic photoconductors. These advantages include improved optical properties such as having a wide range of light absorbing wavelengths, improved electrical properties such as having high sensitivity and stable chargeability, availability of materials, good manufacturability, low cost, and low toxicity.

While the above enumerated performance and advantages exhibited by an organic photoconductor drums are significant, inorganic photoconductor drums traditionally exhibit much higher durability—thereby resulting in a photoconductor having a desirable longer life. Inorganic photoconductor drums (e.g., amorphous silicon photoconductor drums) are ceramic-based, thus are extremely hard and abrasion resistant. Conversely, the surface of an organic photoconductor drums is typically comprised of a low molecular weight charge transport material, and an inert polymeric binder and are susceptible to scratches and abrasions. Therefore, the drawback of using organic photoconductor drums typically arises from mechanical abrasion of the surface layer of the photoconductor drum due to repeated use. Abrasion of photoconductor drum surface may arise from its interaction with print media (e.g. paper), paper dust, or other components of the electrophotographic image forming device such as the cleaner blade or charge roll. The abrasion of photoconductor drum surface degrades its electrical properties, such as sensitivity and charging properties. Electrical degradation results in poor image quality, such as lower optical density, and background fouling. When a photoconductor drum is locally abraded, images often have black toner bands due to the inability to hold charge in the thinner regions. This black banding on the print media often marks the end of the life of the photoconductor drum, thereby causing the owner of the printer with no choice but to purchase another expensive photoconductor drum. Photoconductor drum lives in the industry are extremely variable. Usually organic photoconductor drums can print between about 40,000 pages before they have to be replaced.

Increasing the life of the photoconductor drum will allow the photoconductor drum to become a permanent part of the electrophotographic image forming device. In other words, the photoconductor drum will no longer be a replaceable unit nor be viewed as a consumable item that has to be purchased multiple times by the owner of the ep printer. Photoconductor drums having an 'ultra long life' allow the printer to operate with a lower cost-per-page, more stable image quality, and less waste leading to a greater customer satisfaction with his or her printing experience. A photoconductor drum having an ultra ling life can be defined as a photoconductor drum having the ability to print at a minimum 100,000 pages before the consumer has to purchase a replacement photoconductor drum.

To achieve a long life photoconductor drum, especially with organic photoconductor drum, a protective overcoat layer may be coated onto the surface of the photoconductor drum. An overcoat layer formed from a silicon material has been known to improve life of the photoconductor drums used for color printers. However, such overcoat layer does not have the robustness for edge wear of photoconductor drums used in mono (black ink only) printers. A robust overcoat layer that improves wear resistance and extends life of photoconductor drums for both mono and color printers is desired.

Some overcoats are known to extend the life of the photoconductor drums. However one major drawback of these overcoats is that they significantly alter the electrophotographic properties of the photoconductor drum in a negative way. If the overcoat layer is too electrically insulating, the photoconductor drum will not discharge and will result in a poor latent image. On the other hand, if the overcoat layer is too electrically conducting, then the electrostatic latent image will spread resulting in a blurred image. Thus, a protective overcoat layer that extends the life of the photoconductor drum must not negatively alter the electrophotographic properties of the photoconductor drum, thereby allowing sufficient charge migration through the overcoat layer to the photoconductor surface for adequate development of the latent image with toner.

SUMMARY

The present disclosure provides an overcoat layer for an organic photoconductor drum of an electrophotographic image forming device. The overcoat layer is prepared from an ultraviolet (UV) curable composition including a urethane resin having at least six radical polymerizable functional groups. The at least six radical polymerizable functional groups are selected from the group consisting of acrylate, methacrylate, styrenic, allylic, vinylic, glycidyl ether, epoxy, and combinations thereof. The overcoat layer of the present invention has shown an improved wear and abrasion resistance, thus protecting the organic photoconductor drum from damage and extending its useful life—thereby allowing the successful printing of over 100,000 pages before it has to be replaced by the consumer.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
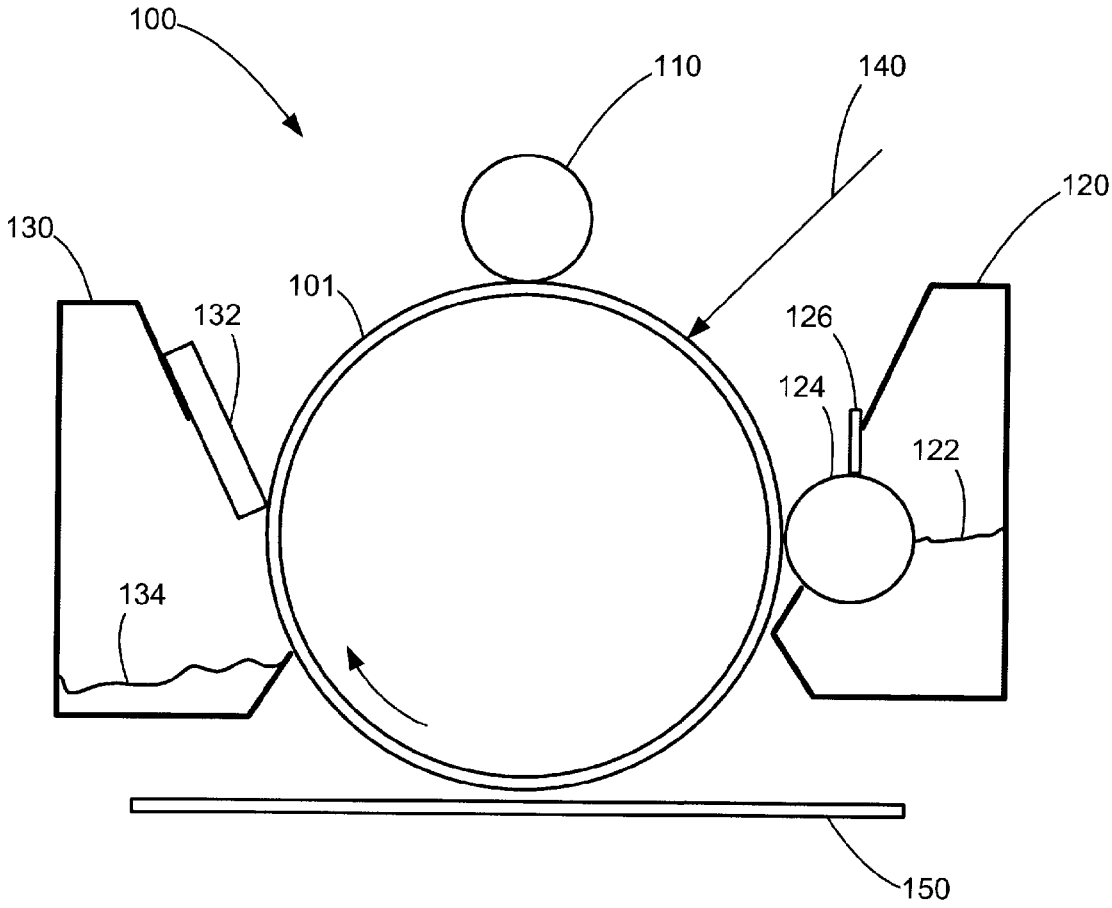
FIG. 1 is a schematic view of an electrophotographic image forming device.

It is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

FIG. 1 illustrates a schematic representation of an example electrophotographic image forming device 100. Image forming device 100 includes a photoconductor drum 101, a charge roll 110, a developer unit 120, and a cleaner unit 130. The electrophotographic printing process is well known in the art and, therefore, is described briefly herein. During a print operation, charge roll 110 charges the surface of photoconductor drum 101. The charged surface of photoconductor drum 101 is then selectively exposed to a laser light source 140 to form an electrostatic latent image on photoconductor drum 101 corresponding to the image being printed. Charged toner from developer unit 120 is picked up by the latent image on photoconductor drum 101 creating a toned image.

Developer unit 120 includes a toner sump 122 having toner particles stored therein and a developer roll 124 that supplies toner from toner sump 122 to photoconductor drum 101. Developer roll 124 is electrically charged and electrostatically attracts the toner particles from toner sump 122. A doctor blade 126 disposed along developer roll 124 provides a substantially uniform layer of toner on developer roll 124 for subsequent transfer to photoconductor drum 101. As developer roll 124 and photoconductor drum 101 rotate, toner particles are electrostatically transferred from developer roll 124 to the latent image on photoconductor drum 101 forming a toned image on the surface of photoconductor drum 101. In one embodiment, developer roll 124 and photoconductor drum 101 rotate in the same rotational direction such that their adjacent surfaces move in opposite directions to facilitate the transfer of toner from developer roll 124 to photoconductor drum 101. A toner adder roll (not shown) may also be provided to supply toner from toner sump 122 to developer roll 124. Further, one or more agitators (not shown) may be provided in toner sump 122 to distribute the toner therein and to break up any clumped toner.

The toned image is then transferred from photoconductor drum 101 to print media 150 (e.g., paper) either directly by photoconductor drum 101 or indirectly by an intermediate transfer member. A fusing unit (not shown) fuses the toner to print media 150. A cleaning blade 132 (or cleaning roll) of cleaner unit 130 removes any residual toner adhering to photoconductor drum 101 after the toner is transferred to print media 150. Waste toner from cleaning blade 132 is held in a waste toner sump 134 in cleaning unit 130. The cleaned surface of photoconductor drum 101 is then ready to be charged again and exposed to laser light source 140 to continue the printing cycle.

The components of image forming device 100 are replaceable as desired. For example, in one embodiment, developer unit 120 is housed in a replaceable unit with photoconductor drum 101, cleaner unit 130 and the main toner supply of image forming device 100. In another embodiment, developer unit 120 is provided with photoconductor drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit, and photoconductor drum 101 and cleaner unit 130 are provided in a second replaceable unit. Further, any other combination of replaceable units may be used as desired. In some example embodiments, the photoconductor drum 101 is not replaceable and becomes a permanent component of the image forming device 100.

Figure 2:
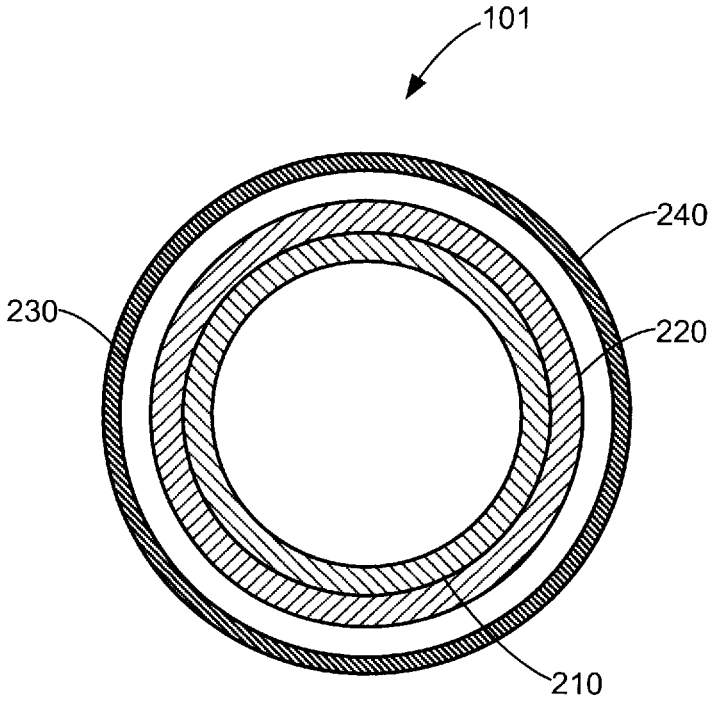
FIG. 2 is a cross-sectional view of an organic photoconductor drum of the electrophotographic image forming device.

FIG. 2 illustrates an example photoconductor drum 101 in more detail. In this example embodiment, the photoconductor drum 101 is an organic photoconductor drum and includes a support element 210, a charge generation layer 220 disposed over the support element 210, a charge transport layer 230 disposed over the charge generation layer 220, and a protective overcoat layer 240 formed as an outermost layer of the organic photoconductor drum 101. Additional layers may be included between the support element 210, the charge generation layer 220 and the charge transport layer 230, including adhesive and/or coating layers.

The support element 210 as illustrated in FIG. 2 is generally cylindrical. However the support element 210 may assume other shapes or may be formed into a belt. In one example embodiment, the support element 210 may be formed from a conductive material, such as aluminum, iron, copper, gold, silver, etc. as well as alloys thereof. The surface of the support element 210 may be treated, such as by anodizing and/or sealing. In some example embodiment, the support element 210 may be formed from a polymeric material and coated with a conductive coating.

The charge generation layer 220 is designed for the photogeneration of charge carriers. The charge generation layer 220 may include a binder and a charge generation compound. The charge generation compound may be understood as any compound that may generate a charge carrier in response to light. In one example embodiment, the charge generation compound may comprise a pigment being dispersed evenly in one or more types of binders.

The charge transport layer 230 is designed to transport the generated charges. The charge transport layer 230 may include a binder and a charge transport compound. The charge transport compound may be understood as any compound that may contribute to surface charge retention in the dark and to charge transport under light exposure. In one example embodiment, the charge transport compound may include organic materials capable of accepting and transporting charges.

In an example embodiment, the charge generation layer 220 and the charge transport layer 230 are configured to combine in a single layer. In such configuration, the charge generation compound and charge transport compound are mixed in the single layer.

The overcoat layer 240 is designed to protect the organic photoconductor drum 101 from wear and abrasion without altering the electrophotographic properties, thus extending the service life of the photoconductor drum 101. The overcoat layer 240 has a thickness of about 0.1 μm to about 10 μm. Specifically, the overcoat layer 240 has a thickness of about 1 μm to about 6 μm, and more specifically a thickness of about 3 μm to about 5 μm. The thickness of the overcoat layer 240 is kept at a range that will not adversely affect the electrophotographic properties of the organic photoconductor drum 101. In one example embodiment, the overcoat layer 240 has a thickness of about 0.1 μm to about 2 μm, specifically a thickness of about 0.5 μm to about 1 μm.

In an example embodiment, the overcoat layer 240 includes a three-dimensional, highly crosslinked structure formed from a UV curable composition including a urethane resin having at least six radical polymerizable functional groups. The inventors have discovered that the optimum number of functional groups need to be at least 6 to ensure that the resulting overcoat extends the useful life of the photoconductor drum unit, thereby allowing the printer to print at least 100,00 pages before the photoconductor drum unit has to be replaced.

These functional groups participate in the crosslinking of the urethane resin upon curing. The at least six radical polymerizable functional groups may be the same or different, and are selected from the group consisting of acrylate, methacrylate, styrenic, allylic, vinylic, glycidyl ether, epoxy, and combinations thereof. A particularly useful urethane resin is chosen from the group including: (1) a hexa-functional aromatic urethane acrylate resin; (2) a hexa-functional aliphatic urethane acrylate resin or (3) combinations of a hexa-functional aromatic urethane acrylate resin and a hexa-functional aliphatic urethane acrylate resin.

Suitable hexa-functional aromatic urethane acrylate resin has the following structure:

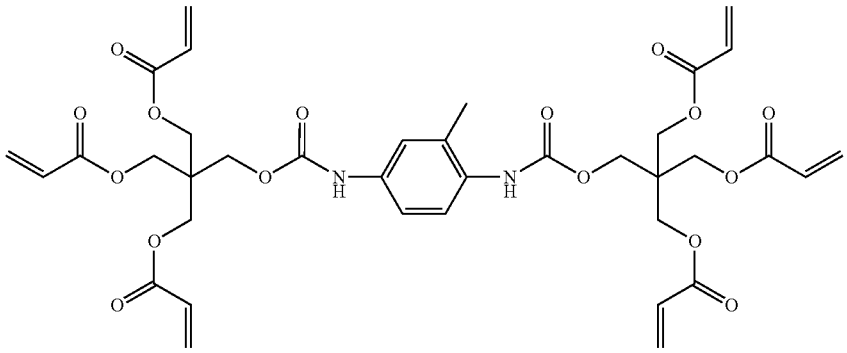

and is commercially available under the trade name CN975, manufactured by Sartomer Corporation, Exton, Pa.

Suitable hexa-functional aliphatic urethane acrylate resin has the following structure:

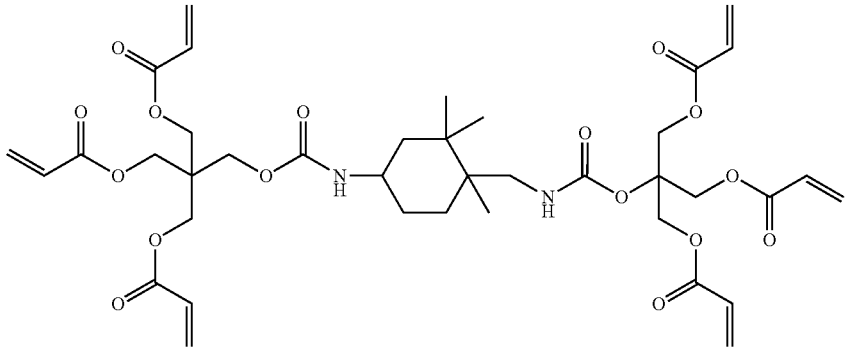

and is commercially available under the trade name EBECRYL® 8301 manufactured by Cytec Industries, Woodland Park, N.J.

Hexacoordinate urethane acrylates may also be synthesized using readily available starting materials, and well established synthetic methods. An Example of the synthesis of a hexacoordinate urethane acrylate is shown below.

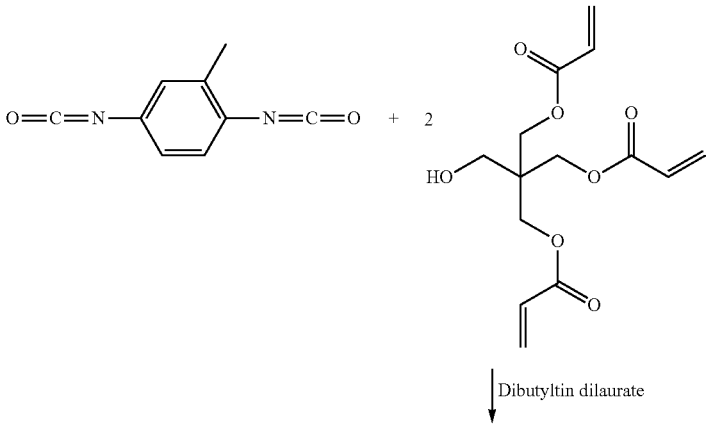

-continued

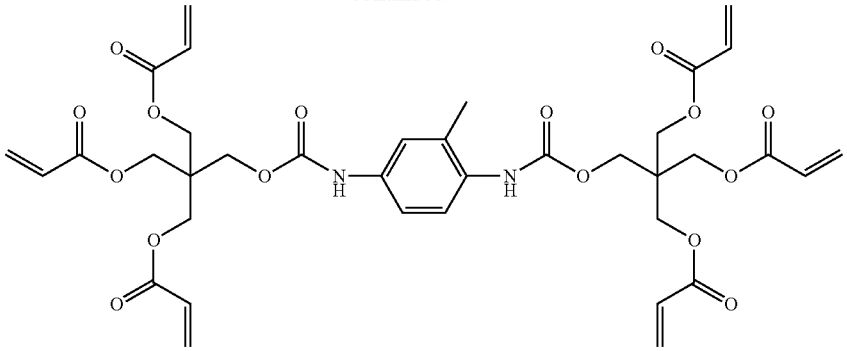

The urethane acrylate synthesis involves reaction of a diisocyanate with pentaerythritol triacrylate. In general, urethane acrylate chemistry involves reaction of an isocyanate with a hydroxy acrylate in the presence of a catalyst. The choice of isocyanate and/or hydroxy acrylate dictates the mechanical and thermal properties of the UV cured material. Curing of urethane acrylates, such as those described above, creates a 3-dimensionally crosslinked structure. Increasing the crosslink density of the UV cured material is one way to improve the mechanical and thermal properties of the materials. Urethane acrylates comprising at least six radical polymerizable functional groups are preferred since crosslink density increases with the number of radical polymerizable functional groups. High crosslink density is known to improve properties such as abrasion and chemical resistance. The crosslinked 3-dimensional network should be homogeneous throughout the cured material, since this improves mechanical and thermal properties. Homogeneous crosslinking is also important for applications requiring a high degree of optical transparency.

The urethane acrylate resin having at least six functional groups provides the overcoat layer 240 with excellent abrasion resistance. These materials are most often used when a clear, thin, abrasion or impact resistant coating is required to protect an underlying structure. Industrial applications include automotive and floor coatings with thicknesses ranging from tens to hundreds of microns. The goal of this type of overcoat is passive in nature—the overcoat is there to simply protect the underlying structure. Conversely in the present invention, the overcoat is not performing only a protective function. The overcoat of the present invention needs to be formulated in such a way as to allow the necessary charge migration generated from the photoconductor drum to travel through the overcoat itself. A successful charge migration is essential to the operation of a photoconductor. Overcoat applications for floors and automobiles do not require any charge migration to occur through the overcoat layer itself.

In an electrophotographic printer, such as a laser printer, an electrostatic image is created by illuminating a portion of the photoconductor surface in an image-wise manner. The wavelength of light used for this illumination is most typically matched to the absorption max of a charge generation material, such as titanylphthalocyanine. Absorption of light results in creation of an electron-hole pair. Under the influence of a strong electrical field, the electron and the hole (radical cation) dissociate and migrate in a field-directed manner. Photoconductors operating in a negative charging manner moves holes to the surface and electrons to ground. The holes discharge the photoconductor surface, thus leading to creation of the latent image. A very thin layer comprising a crosslinked hexacoordinate urethane aromatic or aliphatic acrylate allows for the successful creation of the latent image, while simultaneously dramatically improving the abrasion resistance of the photoconductor drum. Ultimately this overcoat formulation of the present invention leads to a photoconductor drum having an 'ultra long life', thereby allowing a consumer to successfully print at least 100,000 pages on their printer before a replacement photoconductor drum has to be purchased.

In an example embodiment, the curable overcoat composition includes a photo initiator. Specific examples of photo initiators include acetone or ketal photo polymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-molpholinophenyl) butanone-1,2-hydroxy-2-methyl-1-phenylpropane-1-one, 1-phenyl-1,2-propanedion-2-(o-ethoxycarbonyl)oxime; poly{2-hydroxy-2-methyl-1-[4-(1methylvinyl)phenyl]propan-1-one} and 2-hydroxy-2-methyl-1-phenyl-propan-1-one; benzoinether photo polymerization initiators such as benzoin, benzoinmethylether, benzoinethylether, benzoinisobutylether and benzoinisopropylether; benzophenone photo polymerization initiators such as benzophenone, 4-hydroxybenzophenone, o-benzoylmethylbenzoate, 2-benzoylnaphthalene, 4-benzoylviphenyl, 4-benzoylphenylether, acrylated benzophenone and 1,4-benzoylbenzene; thioxanthone photo polymerization initiators such as 2-isopropylthioxanthone, 2-chlorothioxanthone, 2,4-dimethylthioxanthone, 2,4-diethylthioxanthone and 2,4-dichlorothioxanthone; phenylglyoxylate photo initiators such as methylbenzoylformate and other photo polymerization initiators such as ethylanthraquinone, 2,4,6-trimethylbenzoyldiphenylphosphineoxide, 2,4,6-trimethylbenzoyldiphenylethoxyphosphineoxide, bis(2,4,6-trimethylbenzoyl) phenylphosphineoxide, bis(2,4-dimethoxybenzoyl)-2,4,4-trimethylpentylphosphineoxide, methylphenylglyoxyester, 9,10-phenanthrene, acridine compounds, triazine compounds and imidazole compounds. Further, a material having a photo polymerizing effect can be used alone or in combination with the above-mentioned photo polymerization initiators. Specific examples of the materials include triethanolamine, methyldiethanol amine, 4-dimethylaminoethylbenzoate, 4-dimethylaminoisoamylbenzoate, ethyl(2-dimethylamino)benzoate and 4,4-dimethylaminobenzophenone. These polymerization initiators can be used alone or in combination. The surface layer of the present invention preferably includes the polymerization initiators in an amount of 0.5 to 20 parts by weight and more specifically from 2 to 10 parts by weight per 100 parts by weight of the radical polymerizable compounds. Useful photo initiators include a blend of poly{2-hydroxy-2-methyl-1-[4-(1methylvinyl)phenyl]propan-1-one} and 2-hydroxy-2-methyl-1-phenyl-propan-1-one, manufactured by Lamberti USA Inc and sold under the trade name ESACURE KIP® 100 F and 1-hydroxy-cyclohexyl-phenyl-ketone manufactured by BASF Corp. and sold under the trade name IRGACURE® 184.

The curable overcoat composition of the present invention is prepared by dissolving the urethane resin in a solvent. The solvent includes organic solvent such as tetrahydrofuran, toluene and alcohols. In one example embodiment, the solvent includes a mixture of two or more organic solvents to maximize solubility of the urethane resin. The curable overcoat composition is coated on the outermost surface of the organic photoconductor drum 101 through dipping or spraying. If the curable overcoat composition is applied through dip coating, the solvent comprises alcohol to minimize dissolution of the components of the charge transport layer 230. The alcohol solvent includes isopropanol, methanol, ethanol, butanol, or combinations thereof. The amount of the alcohol solvent used in the overcoat formulations is between 85% and 95%, more particularly 90%.

The coated curable composition is then pre-baked to remove residual solvent, and exposed to an UV electromagnetic radiation at an energy and a wavelength suitable for the formation of free radicals to initiate the crosslinking. The exposed overcoat composition is then post-baked to anneal and relieve stresses in the coating.

EXAMPLES

Example 1

The charge generation layer was prepared from a dispersion including type IV titanyl phthalocyanine, polyvinylbutyral, poly(methyl-phenyl)siloxane and polyhydroxystyrene at a weight ratio of 45:27.5:24.75:2.75 in a mixture of 2-butanone and cyclohexanone solvents. The polyvinylbutyral is available under the trade name BX-1 by Sekisui Chemical Co., Ltd. The charge generation dispersion was coated onto the aluminum substrate through dip coating and dried at 100° C. for 15 minutes to form the charge generation layer having a thickness of less than 1 μm, specifically a thickness of about 0.2 to about 0.3 μm.

The charge transport layer was prepared from a formulation including terphenyl diamine derivatives and polycarbonate at a weight ratio of 50:50 in a mixed solvent of THF and 1,4-dioxane. The charge transport formulation was coated on top of the charge generation layer and cured at 120° C. for 1 hour to form the charge transport layer having a thickness of about 26 μm as measured by an eddy current tester.

Example 2

A hexa-functional aromatic urethane acrylate resin is dissolved in a 1:1 mixture of toluene/isopropanol at an amount of about 5% by weight together with 5% by weight of photo initiator. The photo initiator comprises a blend of poly{2-hydroxy-2-methyl-1-[4-(1methylvinyl)phenyl]propan-1-one} and 2-hydroxy-2-methyl-1-phenyl-propan-1-one and is available under the tradename ESACURE KIP® 100 F by Lamberti USA Inc. The obtained curable composition is coated over a control photoconductor prepared as described in Example 1. The overcoated photoconductor drum is then cured in a Rayonet RPR200 reactor at maximum UV emission of around 254 nm for 15 minutes. A target overcoat thickness of 1.0 μm is achieved by either varying the ratio (wt./wt.) of urethane acrylate to solvent, or changing the coating speed.

Example 3

A hexa-functional aliphatic urethane acrylate resin is dissolved in a 1:1 mixture of tetrahydrofuran/isopropanol at an amount of about 5% by weight together with 5% by weight of photo initiator. The photo initiator comprises 1-hydroxy-cyclohexyl-phenyl-ketone and is available under the trade name IRGACURE® 184 by BASF Corp. The obtained curable composition is coated over a control photoconductor prepared as described in Example 1. The overcoated photoconductor drum is then cured in a Rayonet RPR200 reactor at maximum UV emission of around 254 nm for 20 minutes. A target overcoat thickness of 1.0 μm is achieved by either varying the ratio (wt./wt.) of urethane acrylate to solvent, or changing the coating speed.

Example 4

A di-functional urethane acrylate is dissolved in a 1:1 mixture of toluene/isopropanol at an amount of about 5% by weight together with 5% by weight of IRGACURE® 184 photo initiator. The obtained curable composition is coated over a control photoconductor prepared as described in Example 1. The overcoated photoconductor drum and then cured in the Rayonet RPR200 reactor at maximum UV emission of around 254 nm for 20 minutes. A target overcoat thickness of 1.0 μm is achieved by either varying the ratio (wt./wt.) of urethane acrylate to solvent, or changing the coating speed.

Example 5

A trimethylolpropane triacrylate is dissolved in a 1:1 mixture of tetrahydrofuran/isopropanol at an amount of about 5% by weight together with 5% by weight of IRGACURE® 184 photo initiator. The obtained curable composition is coated as overcoat layer on the organic photoconductor drum as prepared in Example 1 and then cured in the Rayonet RPR200 reactor at maximum UV emission of around 254 nm for 20 minutes. A target overcoat thickness of 1.0 μm is achieved by either varying the ratio (wt./wt.) of trimethylolpropane triacrylate to solvent, or changing the coating speed.

Curable compositions according to example embodiments and comparable examples were prepared and coated as an overcoat layer on an organic photoconductor drum of a mono printer. The mono printer operates at 40 pages per minute (ppm). In four test runs, the highest number of prints achieved by the photoconductor drum without the overcoat layer is 43,173 pages. This organic photoconductor drum used as the control has a drum life of about 43,173 pages and an average wear rate of about 0.23 μm/1000 pages without the overcoat layer.

As illustrated in Table 1 below, the application of overcoat layer comprising hexa-functional aromatic urethane acrylate resin as prepared in Example 2 at a thickness of 1.0 μm increases the life of the photoconductor drum to 138,000 pages. Application of overcoat layer comprising hexa-functional aliphatic urethane acrylate resin as prepared in Example 3 at thickness of 1.0 μm increases the life of the photoconductor drum to 105,000 pages. Additionally the overcoat layers prepared from the urethane resin having at least six radical polymerizable functional groups significantly improved the wear resistance properties of the organic photoconductor drum, i.e. having an average wear rate of less than about 0.01 μm/1000 pages. Thus, these overcoat layers of the present invention prepared from the urethane resin having at least six radical polymerizable functional groups extend the life of the organic photoconductor drum by more than 100%.

TABLE 1

| Photoconductor Drum | Overcoat Layer Resin Component | Overcoat layer Thickness (μm) | Drum Life (number of printed pages) | Average Wear Rate (μm/1000 pages) |
|---|---|---|---|---|
| Example 1 (without overcoat layer) | — | — | 43,173 | 0.23 |
| Example 2 | hexa-functional aromatic urethane acrylate | 1.0 | 138,000 | <0.01 |

TABLE 1-continued

| Photoconductor Drum | Overcoat Layer Resin Component | Overcoat layer Thickness (μm) | Drum Life (number of printed pages) | Average Wear Rate (μm/1000 pages) |
|---|---|---|---|---|
| Example 3 | hexa-functional aliphatic urethane acrylate | 1.0 | 105,000 | <0.01 |
| Example 4 | di-functional urethane acrylate | 1.0 | 45,170 | 0.21 |
| Example 5 | Trimethylolpropane triacrylate | 1.0 | 50,058 | 0.20 |

As further illustrated in Table 1, the overcoat layers prepared from resins having less than six radical polymerizable functional groups provide negligible improvement to the life of the organic photoconductor drum. An organic photoconductor drum coated with overcoat layer comprising di-functional urethane acrylate, as prepared in Example 4, at thickness of 1.0 μm achieves a drum life of only 45,170 pages. Organic photoconductor drum coated with overcoat layer comprising tri-functional acrylate, as prepared in Example 5, at thickness of 1 μm achieves a drum life of only 50,058 pages. The slight increase of the life of the organic photoconductor drum in Examples 4 and 5 when compared to the photoconductor drum in Example 1 is due to the additional thickness provided by the overcoat layer. The overcoat layers prepared from resins with lesser number of radical polymerizable functional groups have a comparable wear rate to the photoconductor drum in Example 1 having no overcoat, i.e. having an average wear rate of about 0.21 μm/1000 pages for Example 4 and about 0.20 μm/1000 pages for Example 5. Therefore for a photoconductor to have a meaningful drum life and wear rate, its overcoat layer must have a resin having at least 6 functional groups.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. An overcoat layer for an organic photoconductor drum, comprising an ultraviolet curable composition including:

a urethane resin having at least six radical polymerizable functional groups, wherein the radical polymerizable functional groups are selected from the group consisting of acrylate, methacrylate, styrenic, allylic, vinylic, glycidyl ether, epoxy, and combinations thereof, an organic solvent; and a photo initiator wherein the overcoat layer does not interfere with a charge migration process generated from the organic photoconductor drum.

2. The overcoat layer of claim 1, wherein the urethane resin having at least six radical polymerizable functional groups is a hexa-functional aromatic urethane acrylate resin having the following structure:

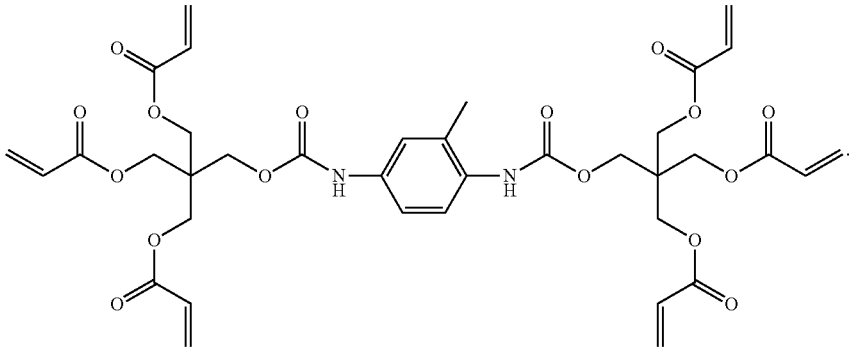

3. The overcoat layer of claim 1, wherein the urethane resin having at least six radical polymerizable functional groups is a hexa-functional aliphatic urethane acrylate resin having the following structure:

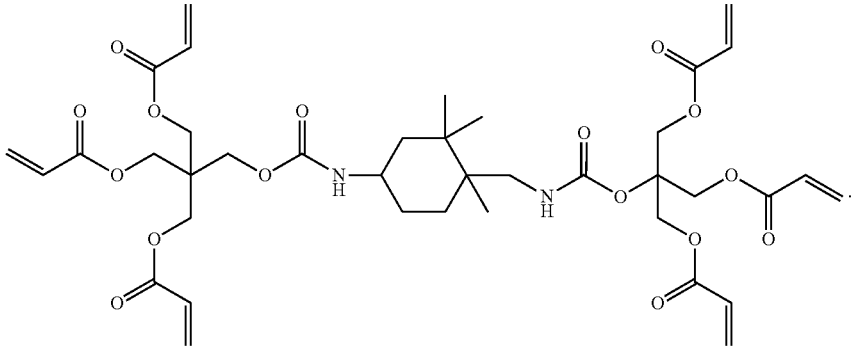

4. The overcoat layer of claim 1, wherein the cured composition has a thickness of about 0.1 μm to about 10 μm.

5. The overcoat layer of claim 1, wherein the cured composition has a thickness of about 0.1 μm to about 2 μm.

6. The overcoat layer of claim 1, wherein a cured curable composition has a thickness of about 0.5 μm to about 1 μm.

7. The overcoat layer of claim 1, wherein the solvent is a mixture of toluene and isopropanol.

8. The overcoat layer of claim 1, wherein the solvent is a mixture of tetrahydrofuran and isopropanol.

9. An organic photoconductor drum comprising:

a support element;

a charge generation layer disposed over the support element;

a charge transport layer disposed over the charge generation layer; and overcoat layer formed as an outermost layer of the organic photoconductor drum, overcoat layer being formed from an ultraviolet curable composition including:

a urethane resin having at least six radical polymerizable functional groups, wherein the radical polymerizable functional groups are selected from the group consisting of acrylate , methacrylate, styrenic, allelic, vinylic, glycidyl ether, epoxy, and combinations thereof, an organic solvent; and a photo initiator, wherein the overcoat layer does not interfere with a charge migration process generated from the organic photoconductor drum.

10. The organic photoconductor drum of claim 9, wherein the urethane resin having at least six radical polymerizable functional groups is a hexa-functional aromatic urethane acrylate resin having the following structure:

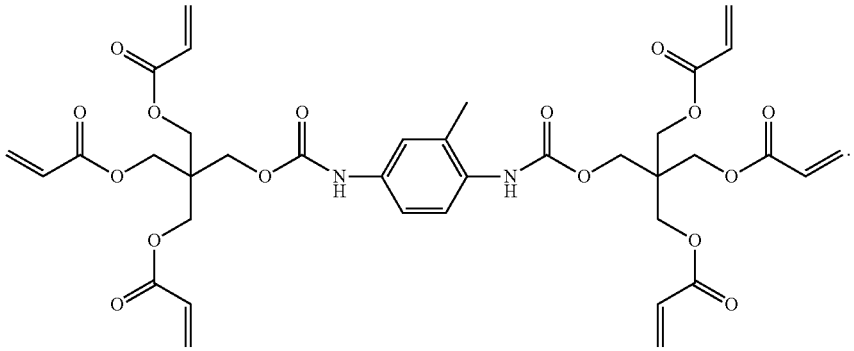

11. The organic photoconductor drum of claim 9, wherein the urethane resin having at least six radical polymerizable functional groups is a hexa-functional aliphatic urethane acrylate resin having the following structure:

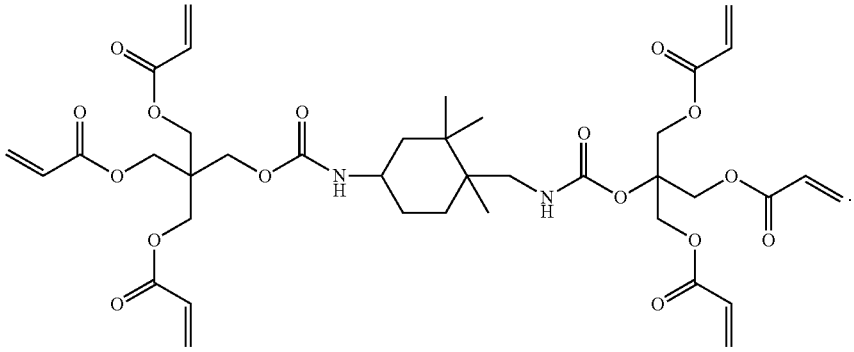

12. The organic photoconductor drum of claim 9, wherein the protective overcoat layer has a thickness of about 0.1 μm to about 10 μm.

13. The organic photoconductor drum of claim 9, wherein the protective overcoat layer has a thickness of about 0.1 μm to about 2 μm.

14. The organic photoconductor drum of claim 9, wherein the protective overcoat layer has a thickness of about 0.5 μm to about 1 μm.

* * * * *